United States Patent [19]

Bannister et al.

[11] Patent Number: 4,881,460

[45] Date of Patent: Nov. 21, 1989

[54] POSTAGE METER AND CONTROL ARRANGEMENT FOR SAME

[75] Inventors: Ray L. Bannister, Richmond; Frederick C. Close, Great Amwell; Peter J. Coeber, Earith, all of United Kingdom

[73] Assignee: Pitney Bowes Inc., Stamford, Conn.

[21] Appl. No.: 89,720

[22] Filed: Aug. 26, 1987

[30] Foreign Application Priority Data

Aug. 27, 1986 [EP] European Pat. Off. ..... 86306619

[51] Int. Cl.[4] ..... B41L 39/00

[52] U.S. Cl. ..... 101/91; 185/40 R; 318/267; 101/234

[58] Field of Search ..... 101/91; 185/40; 318/267, 266, 467

[56] References Cited

U.S. PATENT DOCUMENTS

| | | | |
|---|---|---|---|
| 3,128,698 | 4/1964 | Hennegnin | 101/235 |
| 3,431,844 | 3/1969 | Ogden | 101/234 |
| 3,556,001 | 1/1971 | Kinney et al. | 101/92 |
| 3,682,378 | 8/1972 | Rouan et al. | 235/101 |
| 3,752,067 | 8/1973 | Gill | 101/235 |
| 3,959,703 | 5/1976 | Resen | 318/305 |
| 4,015,523 | 4/1977 | Evans et al. | 101/233 |
| 4,016,467 | 4/1977 | Hallenbeck | 101/235 |
| 4,388,575 | 6/1983 | Lungn | 318/467 |
| 4,441,420 | 4/1984 | Buan | 101/69 |

FOREIGN PATENT DOCUMENTS

| | | | |
|---|---|---|---|
| 2214865 | 2/1974 | Fed. Rep. of Germany | 185/40 |
| 925376 | 5/1960 | France | 101/91 |
| 2142876 | 3/1985 | United Kingdom | 101/93 |

*Primary Examiner*—William Pieprz

*Attorney, Agent, or Firm*—Michael J. DeSha; David E. Pitchenik; Melvin J. Scolnick

[57] ABSTRACT

A postage meter having a rotable print drum also has a control arrangement ensuring that power is fed to the motor which drives the print drum via at least two parallel paths. One of these paths is operative to cause the motor to be driven until an envelope trip switch signifies that the envelope is fully discharged from the meter, irrespective of whether the other path is electrically conductive or not.

7 Claims, 4 Drawing Sheets

(A)
(B)
(C)
(D)
(E)
(F)
32
26
30
10
MOTOR

POSTAGE METER AND CONTROL ARRANGEMENT FOR SAME

FIELD OF THE INVENTION

This invention relates to a postage meter and a control arrangement for a postage meter. Postage meters are sometimes called franking machines.

BACKGROUND TO THE INVENTION AND PRIOR ART

Postage meters are well known and manufacturers are continuously attempting to design meters which combine the desirable attributes of simplicity of use, small size, lightness, low manufacturing cost and reliable, trouble-free operation. A prior art postage meter is shown in U.S. Pat. No. 2 510 350.

The present invention is intended for incorporation in postage meters such as are described, illustrated and claimed in our co-pending patent applications as follows:

U.K. application Ser. No. 2 180 193 published 25th March 1987, European application Ser. No. 222946 published 27th May 1987 and European application No. 86 302 035.0 filed 19th March 1986, and U.S. application Ser. No. 089,640 filed on Aug. 26, 1987. The contents of these applications are hereby incorporated into the present application to the extent necessary for a full understanding of the present invention, in order to avoid redundant repetition.

In some prior known designs of postage meter (see for example British Patent No. 2 056 610) a particular kind of drive coupling (also called a clutch) is included. The Patentees state:

> "With franking machines, a transport or conveying mechanism usually serves both to feed in and press the item to be stamped against a printing drum. Such a transport mechanism needs to be synchronised with the printing control drum of the franking machine in such a way that an exact feeding and conveying of the item is guaranteed during the franking process".

In a certain prior mechanism of this kind, at the end of a single revolution of the print drum, an inner shaft of the drive shaft continues rotating so as to provide drive to an envelope ejection roller. The drive coupling (clutch) ensured that no further rotation of the output shaft from the clutch and hence of the print drum could take place. Because of the single-revolution clutch, the mechanism could not be re-energised for a further single revolution until one revolution has been completed and this revolution would ensure that the envelope had been successfully ejected and the mechanism reset for a fresh franking operation.

OBJECT OF THE INVENTION

It would be desirable, especially from the point of view of costreduction, if it was possible to dispense with such a drive coupling.

SUMMARY OF THE INVENTION

According to one aspect of the invention, there is provided a postage meter having a control arrangement characterised in that power is fed to a motor which directly or indirectly drives the print drum via at least two parallel paths, one of which is operative to cause the motor to be driven until an envelope trip switch signifies that the envelope is fully discharged from the meter irrespective of whether the other path is electrically conductive or not.

According to another aspect of the invention, there is provided a postage meter including a first gear arranged to be driven by a motor in the meter, a second gear driven directly or indirectly by the first gear and arranged to drive a print drum shaft, and a third gear arranged to supply drive energy to an impression roller, the first and third gears being associated with respective cams, herein called, for convenience only, first and third cams, the first cam being arranged in one of its two possible positions to render a solenoid operable and the third cam being arranged to actuate a switch in one of two lines supplying power to the motor, the arrangement being such that electrical actuation of the solenoid cuts off the power supply on the other line to the motor.

According to a further aspect of the invention, in a postage meter of the kind which is normally in a rest position and which intermittently carries out franking operations when an envelope trip switch is triggered by the insertion of an envelope, a mechanism is provided which ensures that a new franking operation cannot be triggered until a preceding envelope being franked has been completely ejected from the meter.

Such complete ejection may be monitored by the reversion of the envelope trip switch to its non-triggered (non-actuated) condition. This occurs when the envelope leaves the bite between the print drum and a confronting impression roller.

In this specification the word "envelope" is to be taken to mean any relatively flat article which is (a) to be mailed, posted or despatched and (b) can be franked by a postage meter.

In contrast to the arrangement shown in British Patent No. 2 056 610, in a meter according to an embodiment of the present invention there is no continuously rotating inner shaft and no single revolution clutch, and the ejection mechanism relies on stored energy in a wound-up spring within the ejection roller, the spring being wound up during the single revolution franking operation, and then causing the ejection roller to continue rotating even after all other drive in the postage meter has ceased.

BRIEF DESCRIPTION OF THE DRAWINGS

The invention will be better understood from the following non-limiting description of examples thereof given with reference to the accompanying drawings in which.

DETAILED DESCRIPTION OF AN EMBODIMENT

One of the problems addressed by this invention is to prevent the postage meter print drum drive mechanism being re-energised to produce a second revolution (i.e. a second franking) if a long envelope is passing through the meter. This may occur since an envelope trip lever 31 (FIG. 3) is generally provided on the "entry" side of a postage meter, which lever is tripped by an envelope being inserted. It actuates an envelope trip switch 32 which energises the motor etc., to provide a single revolution of the print drum shaft. This is conventional in postage meters. All is well with this arrangement if, upon completion of the single revolution (i.e. franking having taken place), the envelope is no longer depressing the trip lever 31. However, if a long envelope is being franked, the trip lever may still be depressed and a second revolution will be commenced. This results in further franking being applied, which registers on the accounting mechanism. The resulting confusion and possible waste of funds is obviously unacceptable to users of the meter.

Figure 3:
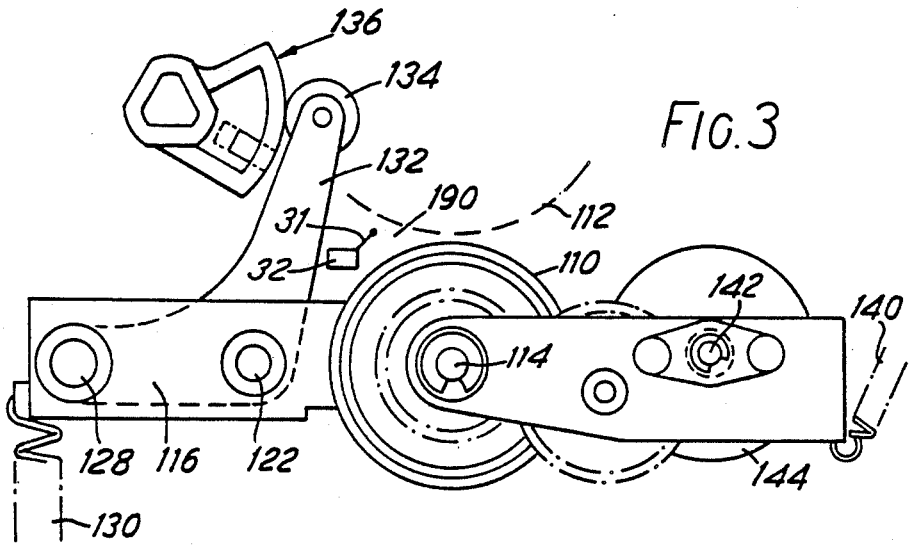
FIG. 3 is a side elevation of one example of impression roller assembly used in an embodiment of the invention.
Figure 4:
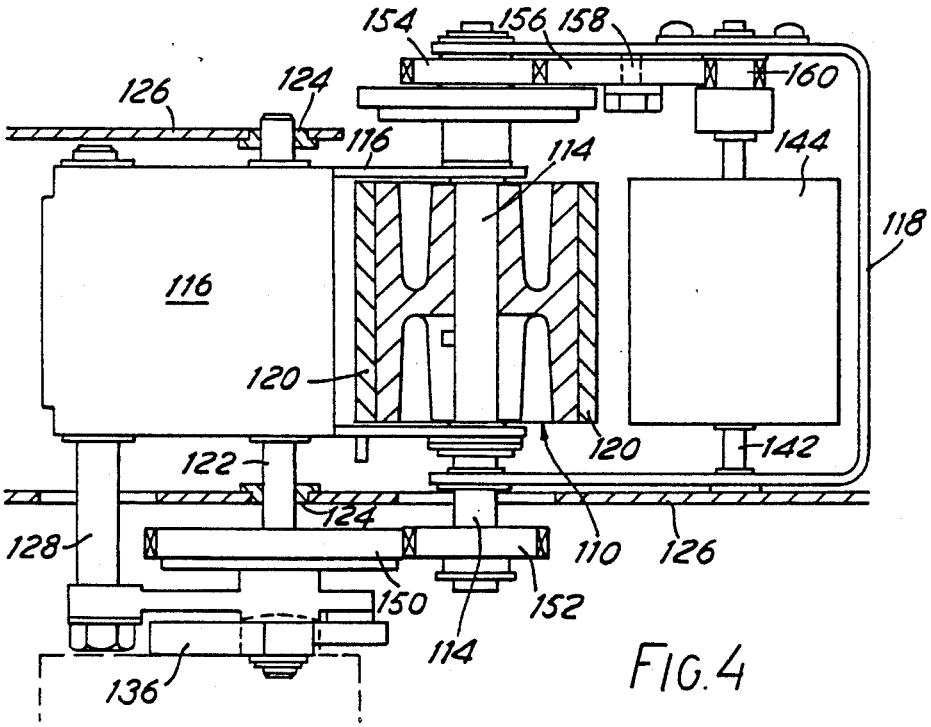
FIG. 4 is a plan view of the assembly shown in FIG. 3.
Figure 5:
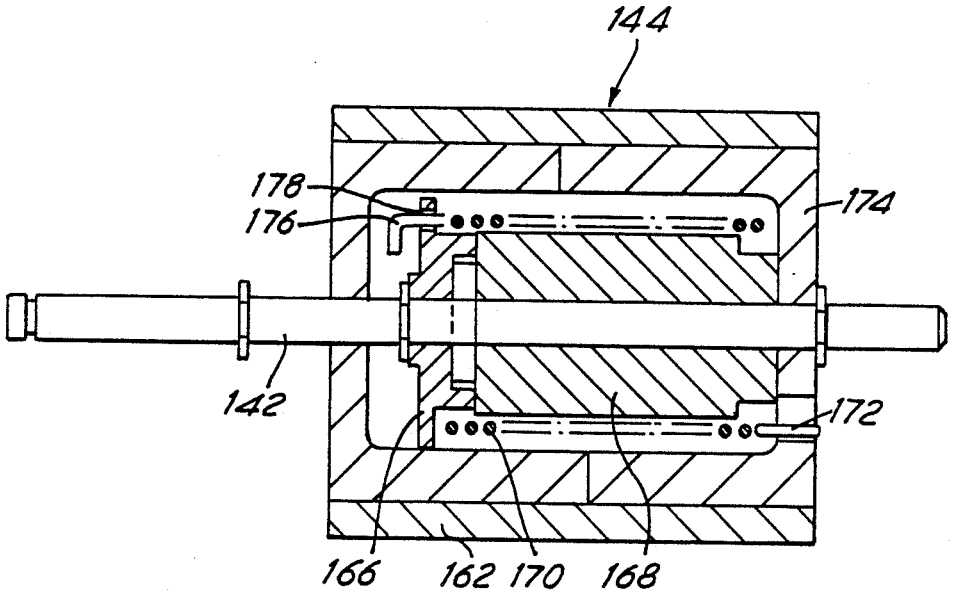
FIG. 5 is an axial cross-section through one example of an ejector roller.

To faciliate understanding of the invention, detailed reference will firstly be made to FIGS. 3–5 showing an impression roller assembly.

Referring now to FIGS. 3 and 4, the illustrated impression roller assembly includes an impression roller 110 disposed opposite a print drum 112 to define a nip therebetween to receive an envelope or other relatively flat article to be franked. The impression roller 110 is carried on a drivable shaft 114 extending through a first bracket member 116 and also through a second, U-shaped, bracket member 118. The impression roller 110 has a surfacing 120 of rubber or other resilient material. The bracket 116 is carried by, and is mounted for pivotal rotation about, a shaft 122, this shaft being carried by journals 124 which are in turn located in and supported by vertical support walls 126 within the postage meter. A shaft 128 extends laterally from one end of the bracket 116 and this end of the bracket is urged downwardly, that is to say, in an anti-clockwise direction of rotation as seen in FIG. 3, by a tension spring 130. The other end of the spring 130 is anchored to a suitable point on the meter chassis (not shown).

Also mounted for pivotal rotation relative to, and about, the shaft 122 is an L-shaped cam follower 132 having a cam follower roller 134. This roller 134 cooperates with a cam 136. The functioning of the cam 136 will be described later.

The U-shaped bracket 118 is freely pivotable about the shaft 114 and is spring urged in an upward direction, anti-clockwise as seen in FIG. 3, by a tension spring 140. The upper end of the tension spring 140 is anchored to a suitable abutment within the postage meter base. A shaft 142 is journalled in the U-shaped bracket 118, and on this shaft an ejector roller 144 is mounted. The ejector roller itself rotates freely with reference to the shaft 142 but contains a wind-up coil spring arrangement, better seen in FIG. 5, connected to the shaft 142. The manner of functioning of this is described in our copending European Patent application No. 86 306 620.5, to which reference is directed.

The shaft 122 carries a gear 150 thereon, which is driven by gearing not shown either directly from an electric motor of the postage meter, or indirectly from said motor via intervening gears or belt drives. The gear 150 is in engagement with a gear 152 which drives the impression roller 110 and also drives a gear 154 on the shaft 114. The gear 154 is in engagement with a further gear 156 freely rotatable relative to a stub shaft which is mounted on the U-shaped bracket 118, the stub shaft being indicated at 158. The gear 156 is in engagement with a further gear 160 which is attached to and drives the shaft 142.

The ejection roller 144, as seen best in FIG. 5, has a surface covering 162 of rubber or like resilient material. Within the ejector roller 144 is housed a disc 166 mounted on and attached to the shaft 142. The disc 166 is in end on relationship with a boss 168 carried by and freely rotatable with reference to the shaft 142. A coil spring 170 has one end 172 extending through a small hole in the end wall 174 of the ejector roller and its other end 176 extending through a small hole 178 at the periphery of the disc 166. In use, rotation of the shaft 142 in one direction will wind up or tighten the coil spring 170, providing the roller 144 is held against rotation by frictional grip of its surface 162 against an envelope or like article. When this restraint on the rotation of the ejector roller 144 is removed, then the coil spring 170 unwinds and causes the ejector roller 144 to rotate. In this way, stored energy is placed into the spring by rotation of shaft 142, is stored therein, and is released to effect a rotation of the ejector roller 44 once the restraint on the latter is removed. The cooperation of the shaft 142 and the coil spring 170 constitutes in effect a means for driving the ejector roller.

In operation, an envelope or like relatively flat article to be franked is fed to the nip 190, FIG. 3, between the print drum 112 and the impression roller 110. In being fed to the nip, the envelope actuates the envelope trip switch 32 (FIGS. 1–3) which starts the print cycle of the machine. As a consequence, the print drum is driven one revolution and the impression roller 110 is correspondingly driven by the gears 150 and 152, the arrangement preferably being such that the peripheral speeds of the surfaces of the print drum and impression roller at the nip are equal so resulting in even feeding of the envelope. During this rotation of the impression roller 110, the gear train 154, 156, 160 is driven, so driving the shaft 142 and storing energy in the coil spring 170. This occurs because there is a gearing up via the gears 154, 156 and 160 causing the rotational speed of the gear 160 to be three times (for example) that of the gear 154. The envelope travels at the speed of the periphery of the impression roller and exerts a frictional braking effect on the periphery of the ejector roller while it is passing through the nip between print drum and impression roller. As a result, the spring in the ejector roller is wound up. At the end of the print drum cycle, the cam 136 is suitable actuated by mechanisms in the meter, rotating the L-shaped lever 132 clockwise as seen in FIG. 3 and hence withdrawing the impression roller 110 downwardly so freeing the envelope from the grip of the nip. This downward movement of the impression roller does not affect the upward spring force acting on the bracket 118 and causing the ejector roller 144 to continue to engage the envelope, but the release of the envelope from the nip 190 removes the restraint on the envelope and the ejector roller is then able to rotate and eject the envelope in a direction to the right as seen in FIG. 3. This ejection is consequently achieved without any separate control system to cause a rotation of the ejector roller at an appropriate time in the print cycle, with resulting reduction in complexity of the meter.

Figure 1:
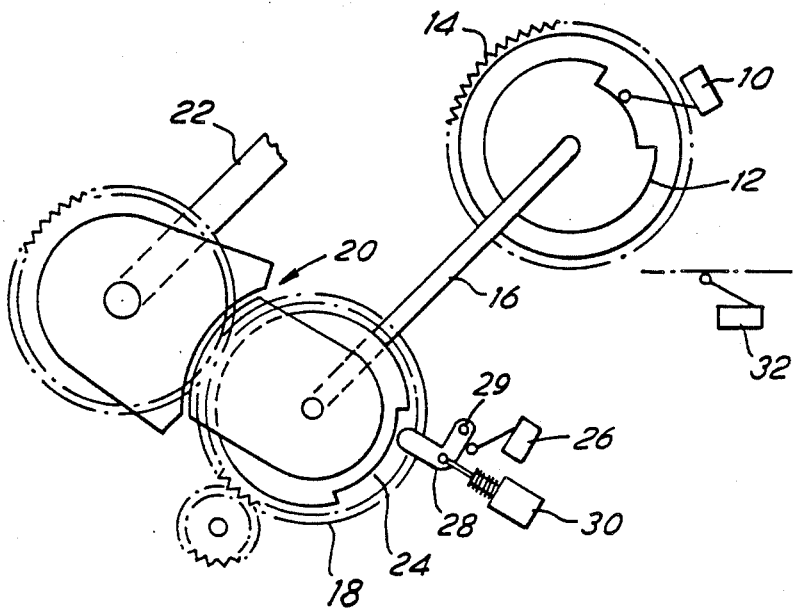
FIG. 1 illustrates diagramatically certain parts of one example of postage meter according to the invention.

Referring now to FIG. 1, a cam-operated switch 10 is provided adjacent a cam 12 (herein also called a first cam) on a gear 14 at the front of a postage meter. The meter, being familiar to a man of average skill in the art, is not fully shown in the drawings herewith. The gear 14 is arranged to drive the impression roller 110 (FIG. 3) of said postage meter. A drive shaft 16 connects the gear 14 to another gear 18 within the postage meter towards its rear, the gear 18 being coupled by an interlocking cam arrangement 20 to gear 21 on a print drum shaft 22. Interlocking cam arrangements of this kind are used to ensure that a print drum shaft makes a single substantially 360° rotation when a print cycle is initiated. Such interlocking cam arrangements are known, one example having been included in the Pitney Bowes 5101 postage meter marketed in U.K. prior to 1966, and will be familiar to a man of average skill and hence need not be further described herein.

The gear 18 includes a cam 24 (herein also called a third cam) which operates a latch switch 26 via a quadrant 28 pivoted at 29. The quadrant 28 is also connected to a solenoid 30. The envelope trip switch 32 is actuated by the envelope trip lever 31. The trip lever 31 is provided along the envelope feed path, at the entrance thereof.

Figure 2:
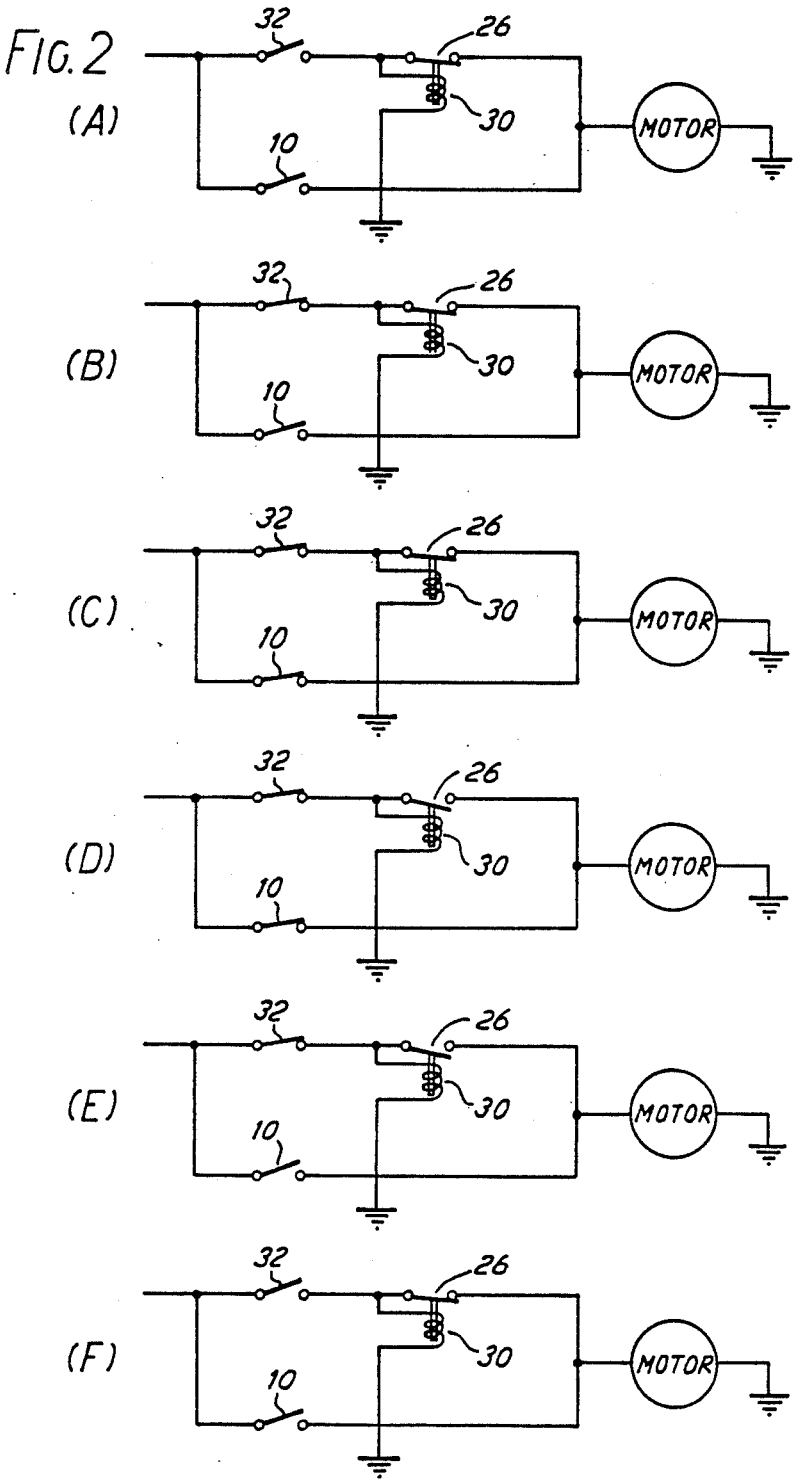
FIGS. 2A to 2F are circuit diagrams showing the positions of solenoid contacts and various switches at stages in a franking cycle.

The cam switch 10, latch switch 26, solenoid 30, trip switch 32 and motor are connected as shown in FIG. 2. It should be noted that the trip switch 32 is normally open and closes when an envelope triggers it. Also, the latch switch 26 is normally closed unless urged open by the solenoid 30. The solenoid 30 is of a special 3-position type which can be held in an inoperative position (armature held away from the influence of the coil) when the cam 24 is at its position in which its lesser diameter portion is in engagement with the quadrant 28. In this position the armature is not moved even if current flows through the solenoid coil. When the raised profile of the cam 24 takes effect, the solenoid 30 is put into an operative position wherein the armature does respond if current flows through the coil.

Operation of the arrangement will be described with reference to FIG. 2, parts (A)–(F).

(A) The meter is in its rest position, drive and print drum shafts being in their home position, with the envelope trip switch 32 open.

(B) An envelope closes the trip switch 32. Since the latch switch 26 is in its normally closed position, power reaches the motor and the shafts 16, 22 start to rotate, feeding the envelope through the meter. It should be noted that the latch switch 26 stays closed because, although the coil of the solenoid 30 is energised, the solenoid 30 is held by spring bias beyond its range of operation by the cam 24. That is to say, in this position the solenoid armature is outside the range of influence of the solenoid coil and so energisation of the solenoid coil cannot shift the armature.

(C) The cam switch 10 closes as the cam 12 changes profile during rotation. There are now two paths in parallel for power to the motor, one via switch 10 and one via switches 32 and 26.

(D) The armature of the solenoid 30 is urged by the cam 24 out of its non-operative position and into an operative position whereupon the solenoid is energised since its armature is now within the influence of the coil and there is a supply of power to its coil via switch 32 which is already closed. The solenoid 30 therefore opens the latch switch 26. Power to the motor is maintained via the closed cam switch 10.

(E) The cam switch 10 opens when the shafts reach their home positions, the power path to the motor is broken and the motor stops. It will be seen that even if the envelope trip switch 32 is still closed, e.g. by a long envelope, power to the motor is still interrupted since the latch switch 26 is held open.

(F) Once the envelope has been ejected and no longer contacts the trip switch 32, the trip switch 32 opens. Power to the solenoid 30 is interrupted and therefore the latch switch 26 returns to its normally closed position. The meter is once more in its rest position.

It will be seen that the precise time at which the envelope trip switch 32 opens is not important, since the power supply to the motor has been taken over by the cam switch 10 path in steps (C) and (D), the latch switch 26 opening during these steps. Thus the arrangement cannot operate to provide another single revolution of the print drum shaft until the trip switch 32 has opened and thus reset the latch switch 26 into its initial (closed) operating position, as shown in step (A) of FIG. 2. In other words, the disclosed mechanism has ensured that a new franking cycle cannot be triggered until a preceding envelope has been completely ejected from the meter, irrespective of the length of the envelope.

The control of the arrangement illustrated involves feeding the motor via two parallel paths. Irrespective of when the envelope trip switch is closed, the motor remains powered until the cam switch 10 is opened.

What we claim

1. A postage meter having printing means for envelopes and comprising:

a motor drive connected to said printing means for operating same, said motor drive requiring a predetermined amount of movement in order to cause said printing means to carry out a single printing operation, and means connected to said motor drive for preventing a second printing operation from being carried out until a current envelope is fully discharged from the meter and the next envelope introduced;

said preventing means comprising:

control means connected to said motor drive for activating same while a current envelope is present in said postage meter, said control means including electrical circuit means operable upon operation of the motor drive during a printing operation to prevent a second printing operation until the drive means has completed the current printing operation and the current envelope has been fully discharged;

said electrical circuit means comprising first and second parallel current paths for activating said motor drive, and means for establishing and interrupting said first and second current paths in response to different states of said postage meter.

2. A postage meter having printing means for envelopes and comprising:

a motor drive connected to said printing means for operating same, said motor drive requiring a predetermined amount of movement in order to cause said printing means to carry out a single printing operation, and means connected to said motor drive for preventing a second printing operation from being carried out until a current envelope is fully discharged from the meter and the next envelope introduced;

said preventing means comprising:

control means connected to said motor drive for activating same while a current envelope is present in said postage meter, said control means including electrical circuit means operable upon operation of the motor drive during a printing operation to prevent a second printing operation until the drive means has completed the current printing operation and the current envelope has been fully discharged;

said electrical circuit means comprising first and second parallel current paths to said drive means, said control means also including:

first and second switches in the first current path and a third switch in the second current path, said first switch being responsive to the presence of an envelope, said second switch being responsive to the condition of the first switch and to the amount of movement of said motor drive, said third switch being response to the amount of movement of said motor drive.

3. A postage meter comprising:

a print drum, a motor drive connected to said print drum for driving same, an envelope trip first switch activated when a current envelope is introduced to the meter for the meter to carry out a printing operation on the envelope, and a control arrangement for controlling said motor drive such that said current envelope is fully discharged from the meter before said motor drive can be reset for printing of the next envelope; said control arrangement comprising:

means providing first and second parallel current paths from a supply source to the motor drive, said first switch being in said first current path, second switch means in series in said first current path, third switch means in said second current path, first means operable by the motor drive to activate the second switch means, second means operable by the motor drive to actuate the third switch means, said control arrangement being operable to de-activate the second switch means before deactivating of the first switch means and to de-activate the third switch means to conclude the current printing operation.

4. A postage meter as claimed in claim 3, wherein said first means comprises a cam driven by the motor drive, and said second means comprises a cam driven by the motor drive.

5. A postage meter as claimed in claim 4, wherein said second switch means includes a solenoid having a coil in series with the first switch.

6. A postage meter as claimed in claim 5, wherein said second switch means is operable only when the cam of the second means has assumed a given position and when the first switch is closed.

7. A postage meter as claimed in claim 3, further comprising a spring-driven ejection drive for said envelope, said ejection driven being operable to store spring energy in response to operation of the drive means and being operable to eject the envelope upon the drive means becoming inoperable.

* * * * *